United States Patent [19]

Schmidlin

[11] 4,014,697

[45] Mar. 29, 1977

[54] ELECTROSTATOGRAPHIC IMAGING MEMBER

[75] Inventor: Fred W. Schmidlin, Pittsford, N.Y.

[73] Assignee: Xerox Corporation, Stamford, Conn.

[22] Filed: Mar. 19, 1975

[21] Appl. No.: 560,283

Related U.S. Application Data

[62] Division of Ser. No. 392,599, Aug. 29, 1973, Pat. No. 3,890,040, which is a division of Ser. No. 212,220, Dec. 27, 1971, abandoned.

[52] U.S. Cl. ..... 96/1.5; 96/1 R; 96/1.4

[51] Int. Cl.[2] ..... G03G 5/04

[58] Field of Search ..... 96/1.5, 1 A, 1.4

[56] References Cited

UNITED STATES PATENTS

| | | | |
|---|---|---|---|
| 3,511,651 | 5/1970 | Rosenberg | 96/1.5 |
| 3,674,475 | 7/1972 | Silverberg | 96/1.5 |

*Primary Examiner*—John D. Welsh

*Attorney, Agent, or Firm*—James J. Ralabate; Richard A. Tomlin; Max J. Kenemore

[57] ABSTRACT

A process for image reproduction comprises the steps of contacting a charge blocking surface on a photoreceptive body with a developer material containing charged toner particles, providing an electric field of predetermined polarity between the photoreceptor and a transfer medium for attracting the toner particles toward the photoreceptor surface, subjecting the photoreceptor to activating radiation in image configuration for inducing an electrostatic charge pattern in image configuration on the photoreceptor near an interface between the blocking layer and the developer material and providing an electric field of opposite polarity between the photoreceptor and the transfer medium for transferring the toner particles in image configuration to the transfer medium. Automated copying apparatus and photographic apparatus in accordance with features of the invention are provided.

1 Claim, 15 Drawing Figures

ELECTROSTATOGRAPHIC IMAGING MEMBER

CROSS-REFERENCE TO RELATED CASES

This application is a division of prior copending application Ser. No. 392,599, filed Aug. 29, 1973, now U.S. Pat. No. 3,890,040, which is a division of prior copending application Ser. No. 212,220, filed Dec. 27, 1971 and now abandoned.

BACKGROUND OF THE INVENTION

This invention relates to electrostatography. The invention relates more particularly to an improved process and apparatus for electrostatography.

In electrostatography an image is reproduced by initially creating an electric charge pattern in image configuration and subsequently utilizing this charge pattern to provide a copy of the image. In one system, the image charge pattern comprises a latent electrostatic charge which is formed on a surface of a photoresponsive body. The latent image is then developed by contacting the surface with a developer material and the developed image is subsequently transferred to a record medium. In another known system, an electric charge pattern is established on pigmented particles which particles are then deposited on a record medium.

In the imaging system wherein a latent electrostatic image is formed on the surface of a photoresponsive body and a developer material contacts the image retention surface, a restriction on processing speed arises as a result of the limited rate at which the developer material can be transported from a source to the surface. This is particularly true with the well known cascade development. Another significant limitation is the relatively weak interaction between the electrostatic latent image and the developer material. This interaction depends upon several factors which in general dictate the use of a relatively thick and correspondingly non-flexible photoreceptor body for the image retention surface. Additionally, separate charging, exposing and developing steps are performed in this imaging process and the performance of these steps is time-consuming and requires relatively expensive and complex apparatus.

Various modifications have been proposed in order to overcome several of these limitations. In U.S. Pat. No. 2,892,709 to E. F. Mayer, the surface of a photoconductor is charged in image configuration through a liquid developer layer while the photoconductor is exposed to a light image. The photoconductor accepts charge in the relatively darker areas thereby forming an electrostatic image on the photoconductor. Toner particles in the liquid developer are drawn to, or precipitate on the surface of the photoconductor in the charged areas thereby forming a visible image. This process is ineffective since it requires the attraction of a charge of one polarity for charging the photoconductor and subsequently requires the attraction of a pigment of an opposite polarity. In another arrangement which is disclosed and claimed in copending U.S. patent application Ser. No. 104,389 filed on Jan. 6, 1971, and which is assigned to the assignee of this invention, an electrophoretic imaging process is provided wherein a suspension of toner particles in an insulating liquid is positioned between a photoconductive electrode and a second electrode. An electric field is established between the electrodes while the photoconductor is exposed to imagewise radiation thereby resulting in an exchange of charge between the photoconductive electrode and toner particles and causing repulsion of the toner particles from the surface of the photoconductive electrode in image configuration. In a further arrangement described in U.S. Pat. No. 2,968,552 to Gundlach which is assigned to the assignee of this invention, particles are deposited on a photoconductive surface and a uniform electrostatic charge is then formed thereon. A transfer medium contacts the charged particles while the particles are exposed through the photoconductive surface in order to provide simultaneous exposure and development.

It is an object of this invention to provide an improved imaging process and apparatus.

Another object of the invention is to provide an improved imaging and in-place development process.

Another object of the invention is to provide an improved imaging process and apparatus which avoids one or more of the above enumerated disadvantages accompanying prior art devices.

Another object of the invention is to provide an electrostatic reproduction process adapted for utilizing a relatively thin photoconductive body.

Another object of the invention is to provide an electrostatic reproduction process of enhanced sensitivity.

Still another object of the invention is to provide an improved electrostatic process adapted for photographic use.

In accordance with the features of this invention, a process for image reproduction comprises the steps of contacting a charge blocking surface on a photoreceptive body with a developer material containing charged toner particles, providing an electric field of predetermined polarity between the photoreceptor and the transfer medium for uniformly attracting the toner particles toward the photoreceptor surface, subjecting the photoreceptor to activating radiation in image configuration for inducing an electrostatic charge pattern in image configuration on the photoreceptor near an interface between the blocking layer and the developer material and providing an electric field of opposite polarity between the photoreceptor and the transfer medium for transferring the toner particles in image configuration to the transfer medium. Automated apparatus and photographic apparatus in accordance with features of the invention are provided.

These and other objects and features of the invention will become apparent with reference to the following specification and to the drawings wherein.

Figure 1:
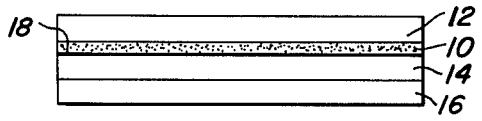
FIG. 1 is a side view in section of an imaging assembly constructed in accordance with features of this invention.

Referring now to FIG. 1, an imaging assembly comprises a film of developing material 10 backed by an image transfer and record medium 12. The transfer and record medium 12 comprises a white paper material for example while the developer film 10 is uniformly coated on the paper 12 to a thickness determined by the maximum optical density desired. While the transfer and record mediums are provided by the single body 12, the transfer and record mediums may comprise separate bodies as is described hereinafter with respect to FIG. 5. The developer material comprises, for example, a colloidal suspension of a toner material such as charcoal in a liquid of suitable viscosity and having a chemical potential relative to the toner for providing that the toner acquires a charge per particle within a specified range. Various suitable suspensions are known for use in the electrostatographic arts. The developer material 10 faces a body of photoreceptor material 14 which is positioned on a transparent backing 16. The photoreceptor body is formed from a photoresponsive material, as for example, cadmium sulfur selenide particles in a suitable binder. An electric charge transfer blocking layer 18 is established at an interface between the photoreceptor body 14 and the developer material 10. The blocking layer 18 may be integral with the body 14 and be formed by natural or artificially prepared surface electric charge traps or it may be provided by a thin film of electrical insulating material such as Mylar having a thickness of less than 1 micron. In use, the imaging assembly is positioned between an electrode 20 and a transparent electrode 22 as illustrated in FIG. 2. The electrode 22 is fabricated of a body of glass, for example having a thin film of transparent, electrically conductive material deposited thereon. The conductive transparent film may comprise tin oxide for example. Alternatively, electrode 22 comprises an integral part of the substrate 16 in the form of a transparent conductive layer.

Figure 2A:
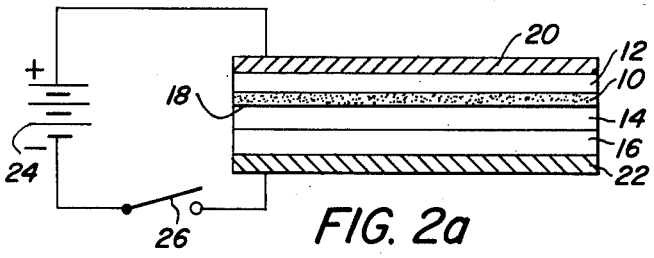
FIGS. 2A–2C are diagrammatic representations of process steps in accordance with one embodiment of this invention.
Figure 2B:
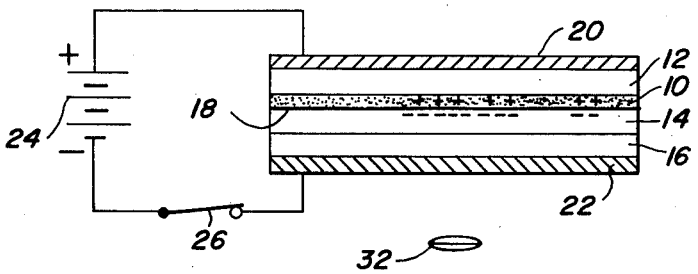
Figure 2B:
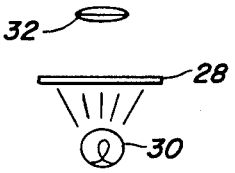
Figure 2C:
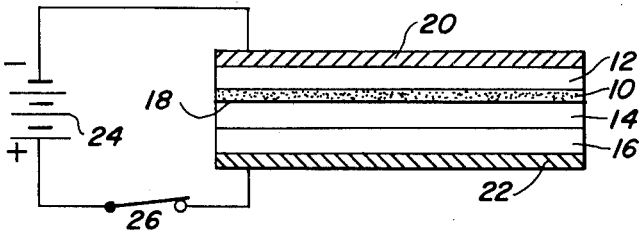

The process steps in accordance with features of this invention are illustrated in FIG. 2A, 2B and 2C. The imaging assembly of FIG. 1 is positioned between electrodes 20 and 22 as shown in FIG. 2A. A source 24 of adjustable D.C. potential is coupled between the electrodes 20 and 22 by suitable wiring and a switch 26. The source of potential and the electrodes provide for the establishment of an electric field gradient across the imaging assembly. A potential is applied to these electrodes by operating the switch 26 as shown in FIG. 2B. Simultaneously the imaging assembly is exposed to an image on a transparency 28 by a lamp 30 and a lens 32 which focuses the image at the photoreceptor surface.

As indicated hereinbefore, developer material includes toner particles suspended in an insulating liquid. These particles acquire a charge as a result of their chemical potential relative to the insulating liquid in which they are suspended. In the exemplary arrangement of FIG. 2B, these particles are shown to have acquired a relatively positive charge. The application of an electric potential between electrodes 20 and 22 having a polarity as indicated in FIG. 2B establishes a force on these positively charged toner particles which causes them to travel through the insulating liquid to the barrier surface 18. The positively charged toner particles are thus uniformly distributed along this barrier surface. Exposure of the photoreceptive material 14 to the image induces an electrostatic image at the surface of the photoreceptor. This image is a negative of the original subject considered to be dark with respect to the background and is represented in FIG. 2B by the accumulation of negatively charged particles near the surface of the photoreceptor. This electrostatic image remains temporarily fixed thereto due to the trapping of the charge by the blocking layer 18. The establishment of this negative charge increases the magnitude of electrostatic force exerted on the positively charged toner particles in those areas conforming to a negative of the image. The polarity of the voltage applied between the electrodes 20 and 22 is then reversed as indicated in FIG. 2C. This reversal in polarity alters the direction of the electric field acting on the toner particles in those areas of the plate corresponding to very little or no light exposure and causes these particles to be drawn toward the record medium 12. By increasing the potential which is applied by the source 24 between the electrodes 20 and 22 as shown in FIG. 2C, the restraining force on the toner particles will be overcome in the unexposed or weakly exposed areas and the toner particles in such areas will be attracted toward the transfer and record medium 20. Thus, a positive of the image to be reproduced is established initially on a record medium while a negative of the same image is established at the surface of the photoreceptor. This process is particularly advantageous in that it provides for direct in-place development accompanying an induced charge in image configuration.

Figure 3A:
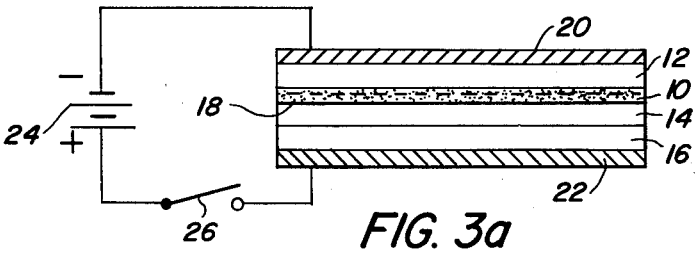
FIGS. 3A and 3B are diagrammatic representations of process steps in accordance with another embodiment of the invention.
Figure 3B:
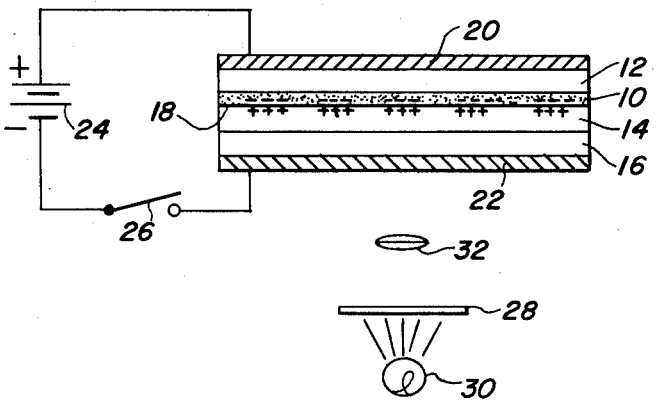

FIGS. 3A and 3B illustrate an alternative embodiment of the imaging process of the invention for forming a positive image on the record medium 12 and a complementary image at the photoreceptor. The polarity of the pigment particles and the polarity of the photoconductor charges are opposite to the polarities employed with respect to the process of FIG. 2. Similarly, the polarity of the applied potentials is also reversed. Suitable photoconductive materials capable of transporting positive charges are arsenic triselenide or other arsenic selenium alloys and polyvinyl carbazole. Negative pigment particles in carriers are well-known and include photosensitive particles and mixtures as are disclosed in U.S. Pat. No. 3,384,566.

Figure 4A:
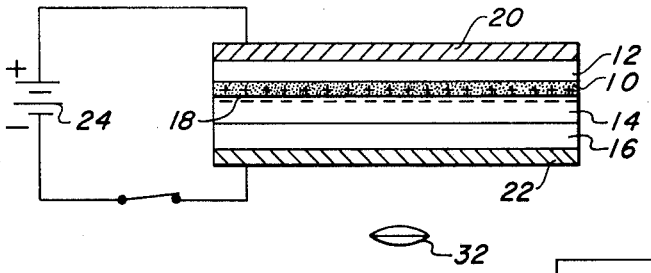
FIGS. 4A and 4B are diagrammatic representations of process steps in accordance with another embodiment of the invention.
Figure 4B:
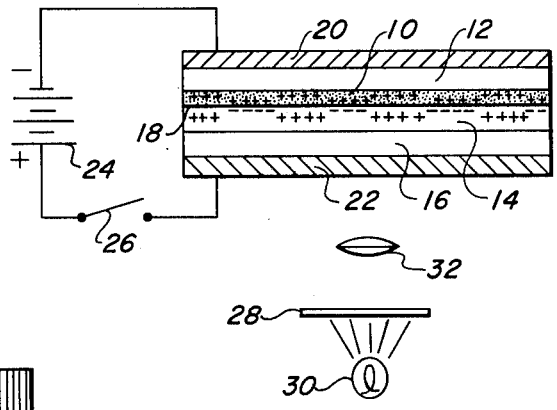

In addition to forming a negative image on the photoreceptor and a positive image on a record medium with the process thus described, a positive image can be formed on the photoreceptor and a negative image on the record medium. This complementary imaging process is accomplished by initially precharging the surface of the photoreceptor to a uniform relatively large potential having a polarity differing from the polarity of the charge on the pigmented particles. The pigmented particles travel to the interface surface as a result of the electrostatic force exerted on the particles both by this potential and the potential and the potential provided by the battery 24 which is coupled between electrodes 20 and 22 for increasing the effective electric field forces operating on the pigment particles. FIG. 4A illustrates the alignment of the pigment particles and the precharge on the surface of the photoconductive body. The photoconductor is then subjected to activating radiation in image configuration by the light source 30, the transparency 28 and the focusing lens 32 while the polarity of the potential applied between the electrodes is reversed. Positive photoconductor charges travel through the photoconductor to the blocking surface 18 in exposed areas. The magnitude of the potential derived from the source 24 and applied between electrodes as illustrated in FIG. 4B is selected to be slightly less than that produced by the uniform charge which was initially formed on the surface of the photoconductor 14. This results in a field acting on the pigment particles which forces them to be attracted toward the photoconductors. Supplementation of the above field by the field produced by the positive photoconductor charges results in reversal of the net field acting on the charged pigment particles in the exposed areas which are thus drawn to the record medium as is illustrated in FIG. 4B. A positive of the image being reproduced remains on the interface surface 18 while a negative of the image being produced is established on the record medium 12.

Negative imaging as illustrated in FIG. 4 utilized the establishment of a relatively high electric field which is provided by the establishment of a precharge on the surface of the photoconductor 14. With the use of an ambipolar photoconductor such as selenium, the surface precharge can be established by initially exposing the photoconductor to uniform activating electromagnetic radiation while simultaneously applying a potential between the electrodes which differs in polarity with respect to the potential which is applied thereto during the imaging and transfer step. As illustrated in FIG. 4A, the ambipolar photoconductor will transfer negative charge to the interface surface during this charging step. Subsequently, when the polarity of the applied potential is reversed, the photoconductor will transfer positive charge to the interface surface in image configuration. Alternatively, when the photoconductor comprises a material which is not ambipolar such as arsenic triselenide or polyvinyl carbazole, then the precharge is applied directly to the surface of the photoreceptor prior to assembly of the sandwich configuration by means such as corona charging or other suitable charging techniques.

Figure 5:
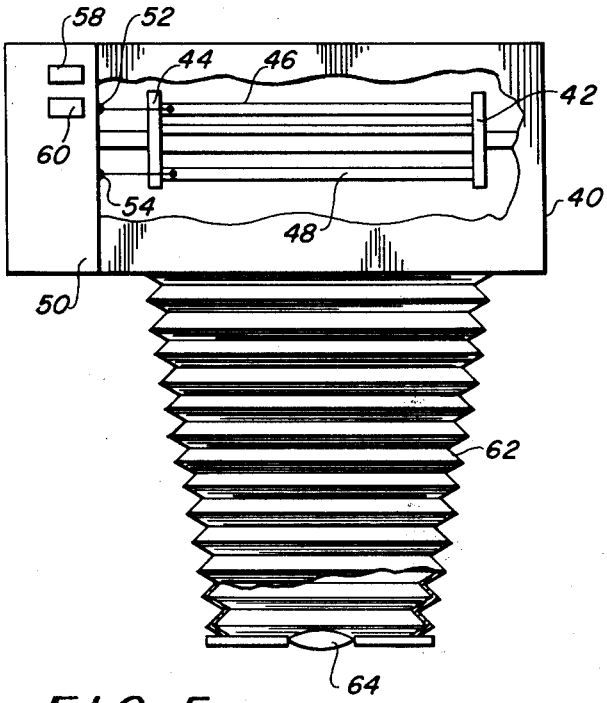
FIG. 5 is a plan view of a camera constructed in accordance with features of this invention.

A camera adapted for employing the process of this invention is illustrated in FIG. 5. The camera includes a box-shaped enclosure 40 having upright guides 42 and 44 positioned therein. These guides are secured to side walls of the enclosure and support electrodes 46 and 48 therebetween. The electrodes are spaced apart a distance for receiving a film strip in position therebetween. A potential is coupled to each of the electrodes from a voltage source which is not shown in detail but which is positioned within a battery operated power pack which is mounted to the enclosure 40 and is represented by the rectangular segment 50. The power pack may comprise any of the conventional high-voltage sources and the potential provided by this source is coupled via feed through connectors 52 and 54 as well as lead-in wires to the electrodes 46 and 48 respectively. A switch 58 is provided for applying potentials to the electrodes during the imaging step. A switch 60 is also provided for reversing the polarity of the potential applied to the electrodes during the developing step. A bellows 62 and lens 64 are provided for the camera along with the usual shutter and aperture arrangements which are well known and which for purposes of clarity in the drawings are not illustrated in FIG. 3.

Figure 6:
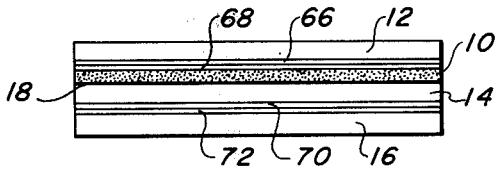
FIG. 6 is a side view of an alternative imaging assembly modified in accordance with features of this invention for use with the camera of FIG. 3.
Figure 11:
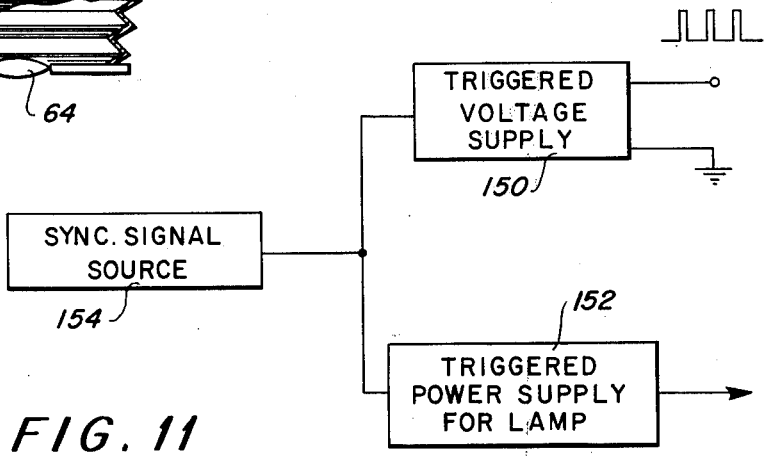
FIG. 11 is a schematic diagram of an alternative arrangement exposing the photoreceptor and for enhancing its sensitivity.

FIG. 6 illustrates an alternative form of the imaging assembly which is particularly useful with the camera of FIG. 5. These elements of FIG. 1 which are illustrated in FIG. 4 and perform the same functions bear the same reference numerals. Although the imaging arrangement illustrated in FIG. 1 operates satisfactorily for photographic applications, film of higher speed, resolution and image quality can be achieved through the use of conductive coatings on both the developer backing and the photoreceptor substrate. A conductive film 66 and an insulating film 68 are positioned between the record medium 12 and the developer material 10. The conductor film 66 has a thickness on the order of 1 mil or less while the insulating film 70 and a conductive film 72 are positioned between the photoreceptor 14 and transparent electrode 16. The use of the conductive films 66 and 72 provides greater coupling between the electrostatic image at the photoreceptor and the developer. Further, the use of these films increases the sensitivity of the photoreceptor and provides for the use of relatively lower voltages in carrying out both the imaging and developing steps than are required with the imaging assembly described with respect to FIGS. 1 and 2.

Figure 7:
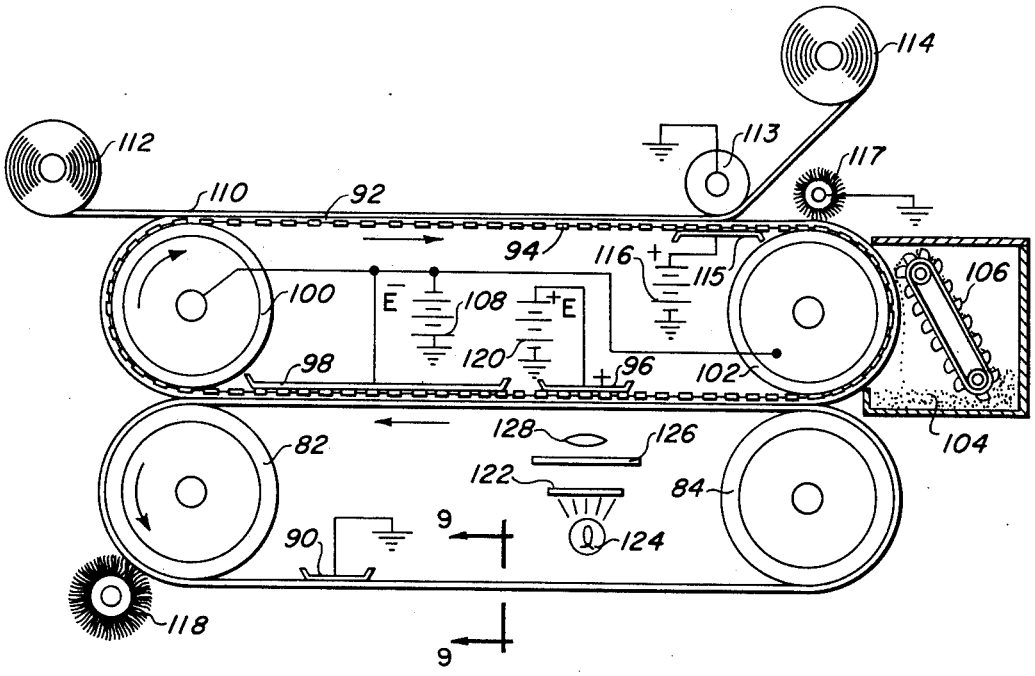
FIG. 7 is a schematic view of an automated apparatus for practicing the present invention.
Figure 8:
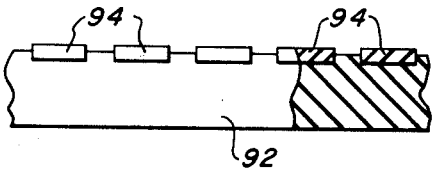
FIG. 8 is an enlarged view of a section of a transfer and developer belt utilized with the apparatus of FIG. 5.
Figure 9:
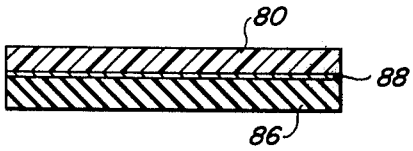
FIG. 9 is a sectional view of an imaging belt taken along lines 9—9 of FIG. 5.

An automated apparatus for continuously imaging and developing in accordance with the process of this invention is illustrated in FIG. 7. The apparatus includes an endless support belt 80 which is positioned about drum rollers 82 and 84 and is transported in counterclockwise direction by these rollers. The belt 80 is formed of Mylar or other transparent support material and includes a film 88 [FIG. 9] of transparent conductive material deposited on a surface of the belt 80 and a film 86 of photoreceptor material deposited on the transparent substrate 88. The conductive film 88 comprises a material which produces an electric charge blocking contact with the photoreceptor. Alternatively, a thin insulating layer between the conductor and photoreceptor is provided. The photoreceptor material comprises for example cadmium sulfur selenium in a suitable binder while the transparent conductive film 88 comprises for example tin oxide. A wiper contact 90 is positioned in contact with the conductive film and is coupled to ground potential for maintaining the film and the belt at ground potential.

A transfer and developer belt 92 is provided for transporting developer material to imaging and developing stations and for transporting a developed image to a transfer station. The belt 92 is formed of an electrically insulating material and includes a plurality of electrically conductive metal strips 94 which are embedded in the belt 92 and extend across the width of the belt. Each segment is spaced longitudinally from an adjacent one and a portion of each conductive segment is exposed at the surface of the belt for contact with an imaging wiper brush 96 and a developing wiper brush 98. The belt 94 is positioned about drum rollers 100 and 102 which rotate and transport the belt in a clockwise direction in contact with the photoreceptor surface 86. Developer material 104 is contained in a reservoir and is deposited on the outer surface of the belt 92 by a conveyor mechanism 106 including a number of buckets positioned on an endless chain which extend in a sump area and convey the material to a location at which it is cascaded over the surface of the belt 92. A negative potential is provided by a voltage source 108 and is applied to the drums 100 and 102 and to the segments 94 through the wiper brush 98 in the vicinity of the developing and coating station for establishing an electrostatic binding force on the belt which causes the developer material to adhere to the outer surface of the belt. A record medium comprising a web or continuous strip of paper 110 is provided and is maintained in contact with the outer surface of the belt 92. The strip is derived from a reel 112 and is fed past a grounded roller 113 to a take-up reel 114. The roller is spaced opposite an electrode 115 to which a positive potential is applied from a source 116 for causing electrostatic transfer of the image to the web. During operation, the powdered surface of the developing belt 92 is cleaned by a grounded rotating brush 117 prior to recoating while the photoreceptive surface 86 on the belt 80 is cleaned by rotating brush 118.

In operation, the belts 80 and 94 are transported in contact through an imaging station and then through a developing station. At the imaging station, the contact brush 96 which is coupled to a source of electrical potential 120 simultaneously contacts a plurality of segments 94 and these segments are thereby maintained at a positive potential. A subject which is to be reproduced from a transparency 122 for example, is positioned at the imaging station and exposure of the photoreceptive film to this transparency is provided by a light source 124, a shutter 126 and a lens 128. The shutter 126 is operated at a rate which provides for an exposure of the moving photoreceptor. Alternatively, the transparency may be transported at the same velocity as the photoreceptor. In the same manner as was described with respect to FIG. 2, the charged particles progress to the surface of the photoreceptor by virtue of the potential applied thereto and an electrical charge in image configuration is established on the photoreceptor surface. The surface of the photoreceptor is adapted to provide sufficient charge traps for retaining the charge in image configuration. The moving belts progress to the development station at which a potential of opposite polarity derived from the source 108 is applied between the belt 92 and the photoreceptor. The toner particles travel toward and adhere to the outer surface of the belt 92 in image configuration. This developed image is transported by the belt 92 to a transfer station at which location the outer surface of the belt 92 contacts the transfer record medium 110 and is electrostatically transferred thereto. The image which is transferred to the medium 110 may be fixed thereto by heat fusing or by other known means.

Subsequent to the transfer, the developer belt 92 is cleaned and retoned at the toning station. The toner is applied to the belt 92 electrostatically in order to control the amount and hence the maximum optical density in the developed image. While the use of a dry form of developing material has been described with respect to FIG. 7, greater control and sensitivity can be accomplished by electrophoretic extraction of toner particles from a liquid bath or mix. A thin layer of insulating fluid then remains on the toner and reduces the non-electrostatic component of adhesion and thereby increases the sensitivity of the system. A reduced non-electrostatic adhesion reduces the electrostatic force required for discriminating to which electrode the toner clings to.

Figure 10:
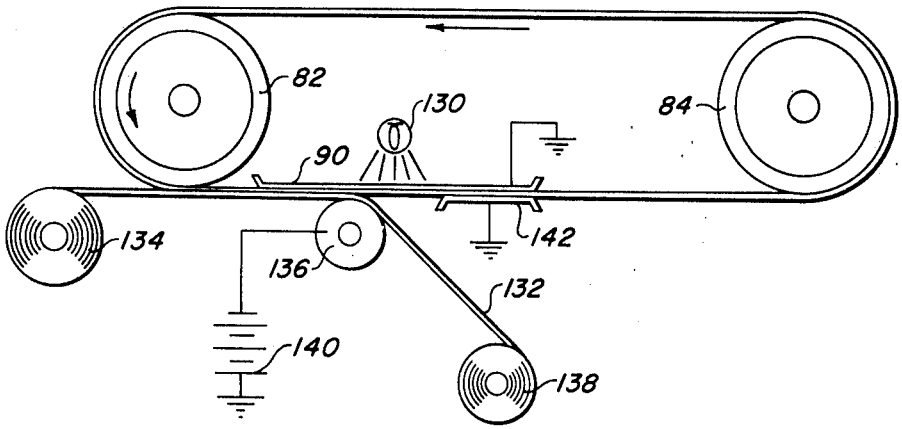
FIG. 10 is a schematic view of an alternative means for cleaning the imaging belt of the apparatus of FIG. 5 and for recording a complementary image.

The belt 80 is cleaned after exposure, as was indicated, by the brush 118. An alternative arrangement for cleaning the belt 80 and for simultaneously providing a record of a complementary image is provided by the arrangement illustrated in FIG. 10. Those elements of FIG. 10 which perform the same functions as elements of FIG. 7 bear the same reference numerals. In FIG. 10, a receiving sheet 132 is provided and is supplied from a roll 134 and is taken up by a roll 138. The sheet 132 is backed at a location intermediate the feed and take-up rolls by a negatively biased roller 136 which is spaced opposite an erase lamp 130. The combination of the erase lamp 130 and the negative biased roller 136 induces a uniform positive charge on the photoreceptor and thereby produces an electrostatic force which causes transfer of pigment from the photoreceptor to receiver sheet 132. This transferred pigment forms a negative of the original image. A grounded electrode 142 is placed opposite the erase lamp and behind the transfer-cleaning station in order to return the surface of the photoreceptor to zero potential. Alternatively, the electrode 142 can be biased to some preferred negative voltage to assist the development process.

The described process and apparatus are particularly advantageous since they provide for the use of relatively thin and hence more flexible photoconductors. The thickness of the latter need only be comparable to the diameter of the toner particles which is typically a few microns. Thus, the photoconductor in accordance with this invention need only be a few microns thick. Photoreceptors capable of secondary conduction or true quantum gain are advantageously used since a counter electrode is present during exposure. This includes utilization of avalanche gain which occurs in two phase or binder type photoreceptors. Higher sensitivity photoreceptors are also feasible for use in the described process and apparatus since they need only be sensitized during exposure. Image degradation due to breakdown or corona which has been encountered in prior apparatus is avoided since development is accomplished in place before the electrostatic image is subjected to relatively large air gaps. High process speeds are now possible since the relatively slower prior art steps of toning, transfer and fusing can be effectively done in parallel through the use of more extended zones. Additionally, as the toner is extracted from a liquid, the liquid can act as a lubricant for facilitating cleaning and effecting greater wear resistance of the belts.

In a particular example not to be deemed limiting in any manner, an imaging assembly comprising a film of developing material consisting of 1/1 Lawter Magenta B 2154/Eicosane is deposited on a recording medium comprising Sterling Litho paper. The photoconductor comprises a 15 to 20 micron layer of 1/1 Monastral Red B/P PE-200 resin deposited on a 2 mil thickness of Mylar. The Mylar is positioned on a NESA body which consists of tin oxide deposited on glass. A blocking layer is formed of a film of styrene-n-butylmethacrylate having a thickness of less than 1 micron. The assembly is exposed with a potential of 7 kilovolts wherein the Mylar is negatively polarized with respect to the Litho paper during an imaging step and the image is then developed by applying a reverse potential of 500 volts and increasing this potential to 1500 volts while the Mylar is maintained positive with respect to the Litho paper. A satisfactory positive image is thereby produced.

While I have illustrated and described particular embodiments of my invention, it will be understood that various modifications may be made therein without departing from the spirit of the invention and the scope of the appended claims.

What is claimed is:

1. An electrostatographic imaging member comprising a layer of transparent electrically insulating material carrying a thin film of transparent electrically conductive material which carries a thin film of transparent electrically insulating material which carries a layer of photoreceptor material;

a layer of developer material including electrophotographic marking particles residing on a substrate and arranged adjacent to said photoreceptor layer, said substrate including a layer of recording material carrying a thin layer of electrically conductive material which carries a thin layer of electrically insulating material, said developer material layer being adjacent said thin electrically insulating material layer of said substrate; and means for establishing a blocking layer for inhibiting the exchange of electrical charge between said developing material and said photoreceptor material.

* * * * *